US007481943B2

(12) United States Patent
McAvoy et al.

(10) Patent No.: US 7,481,943 B2
(45) Date of Patent: Jan. 27, 2009

(54) METHOD SUITABLE FOR ETCHING HYDROPHILLIC TRENCHES IN A SUBSTRATE

(75) Inventors: Gregory John McAvoy, Balmain (AU); Darrell LaRue McReynolds, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 367 days.

(21) Appl. No.: 11/198,235

(22) Filed: Aug. 8, 2005

(65) Prior Publication Data

US 2007/0030309 A1 Feb. 8, 2007

(51) Int. Cl.
*B44C 1/22* (2006.01)

(52) U.S. Cl. ..... 216/37; 216/2; 216/27; 216/36; 216/46; 216/67; 216/79; 438/696; 438/700; 438/706; 438/712; 438/719; 347/20

(58) Field of Classification Search ..... 216/27; 438/695

See application file for complete search history.

(56) References Cited

U.S. PATENT DOCUMENTS

| | | | | |
|---|---|---|---|---|
| 4,717,448 | A * | 1/1988 | Cox et al. | 438/714 |
| 4,782,036 | A * | 11/1988 | Becker et al. | 438/561 |
| 5,658,472 | A * | 8/1997 | Bartha et al. | 216/2 |
| 6,653,237 | B2 * | 11/2003 | Deshmukh et al. | 438/700 |
| 7,098,141 | B1 * | 8/2006 | Kamp et al. | 438/713 |
| 2005/0093912 | A1 * | 5/2005 | Vaideeswaran et al. | 347/20 |

FOREIGN PATENT DOCUMENTS

EP 1079424 A1 2/2001

* cited by examiner

*Primary Examiner*—Nadine Norton
*Assistant Examiner*—Maki Angadi

(57) ABSTRACT

A method suitable for etching hydrophilic trenches into a substrate, such as silicon, is provided. The method comprises etching and sidewall passivation processes for achieving anisotropy. Sidewalls of the etched trench are made hydrophilic during the etch by virtue of a hydrophilizing dopant in a passivating gas plasma. The method is useful for etching ink supply channels in inkjet printheads.

23 Claims, 4 Drawing Sheets

METHOD SUITABLE FOR ETCHING HYDROPHILLIC TRENCHES IN A SUBSTRATE

FIELD OF THE INVENTION

This invention relates to a method of etching a substrate and is suitable for forming deep or ultradeep trenches having hydrophilic sidewalls. It has been developed primarily to provide hydrophilic trenches or channels in silicon substrates, whilst avoiding the use of complex etching procedures or post-etching treatments.

BACKGROUND OF THE INVENTION

The impact of MEMS (Microelectromechanical Systems) devices on the microelectronics industry has been extremely significant in recent years. Indeed, MEMS is one of the fastest growing areas of microelectronics. The growth of MEMS has been enabled, to a large extent, by the extension of silicon-based photolithography to the manufacture of micro-scale mechanical devices and structures. Photolithographic techniques, of course, rely on reliable etching techniques, which allow accurate etching of a silicon substrate revealed beneath a mask.

MEMS devices have found applications in a wide variety of fields, such as in physical, chemical and biological sensing devices. One important application of MEMS devices is in inkjet printheads, where micro-scale actuators for inkjet nozzles may be manufactured using MEMS techniques. The present Applicant has developed printheads incorporating MEMS ink ejection devices and these are described in the following patents and patent applications, all of which are incorporated herein by reference.

| | | | | | |
|---|---|---|---|---|---|
| 6750901 | 6476863 | 6788336 | 6322181 | 7364256 | 7258417 |
| 7293853 | 7328968 | 7270395 | 11/003404 | 11/003419 | 7334864 |
| 7255419 | 7284819 | 7229148 | 7258416 | 7273263 | 7270393 |
| 6984017 | 7347526 | 7357477 | 11/003463 | 7364255 | 7357476 |
| 11/003614 | 7284820 | 7341328 | 7246875 | 7322669 | 6623101 |
| 6406129 | 6505916 | 6457809 | 6550895 | 6457812 | 7152962 |
| 6428133 | 10/407212 | 7252366 | 10/683064 | 7360865 | 6746105 |
| 7156508 | 7159972 | 7083271 | 7165834 | 7080894 | 7201469 |
| 7090336 | 7156489 | 10/760233 | 10/760246 | 7083257 | 7258422 |
| 7255423 | 7219980 | 10/760253 | 10/760255 | 7367649 | 7118192 |
| 10/760194 | 7322672 | 7077505 | 7198354 | 7077504 | 10/760189 |
| 7198355 | 10/760232 | 7322676 | 7152959 | 7213906 | 7178901 |
| 7222938 | 7108353 | 7104629 | 7246886 | 7128400 | 7108355 |
| 6991322 | 7287836 | 7118197 | 10/728784 | 7364269 | 7077493 |
| 6962402 | 10/728803 | 7147308 | 10/728779 | 7118198 | 7168790 |
| 7172270 | 7229155 | 6830318 | 7195342 | 7175261 | 10/773183 |
| 7108356 | 7118202 | 10/773186 | 7134744 | 10/773185 | 7134743 |
| 7182439 | 7210768 | 10/773187 | 7134745 | 7156484 | 7118201 |
| 7111926 | 10/773184 | 7018021 | 11/060751 | 11/060805 | 11/097308 |
| 11/097309 | 7246876 | 11/097299 | 11/097310 | 7377623 | 7334876 |
| 10/727181 | 10/727162 | 7377608 | 10/727245 | 7121639 | 7165824 |
| 7152942 | 10/727157 | 7181572 | 7096137 | 7302592 | 7278034 |
| 7188282 | 10/727159 | 10/727180 | 10/727179 | 10/727192 | 10/727274 |
| 10/727164 | 10/727161 | 10/727198 | 10/727158 | 10/754536 | 10/754938 |
| 10/727160 | 10/934720 | 7369270 | 6795215 | 7070098 | 7154638 |
| 6805419 | 6859289 | 6977751 | 6398332 | 6394573 | 6622923 |
| 6747760 | 6921144 | 10/884881 | 7092112 | 7192106 | 11/039866 |
| 7173739 | 6986560 | 7008033 | 11/148237 | 7374266 | 10/854522 |
| 10/854488 | 7281330 | 10/854503 | 7328956 | 10/854509 | 7188928 |
| 7093989 | 7377609 | 10/854495 | 10/854498 | 10/854511 | 10/854512 |
| 10/854525 | 10/854526 | 10/854516 | 7252353 | 10/854515 | 7267417 |
| 10/854505 | 10/854493 | 7275805 | 7314261 | 10/854490 | 7281777 |
| 7290852 | 10/854528 | 10/854523 | 10/854527 | 10/854524 | 10/854520 |
| 10/854514 | 10/854519 | 10/854513 | 10/854499 | 10/854501 | 7266661 |
| 7243193 | 10/854518 | 10/854517 | 10/934628 | 10/760254 | 10/760210 |
| 7364263 | 7201468 | 7360868 | 10/760249 | 7234802 | 7303255 |

-continued

| | | | | | |
|---|---|---|---|---|---|
| 7287846 | 7156511 | 10/760264 | 7258432 | 7097291 | 10/760222 |
| 10/760248 | 7083273 | 7367647 | 7374355 | 10/760204 | 10/760205 |
| 10/760206 | 10/760267 | 10/760270 | 7198352 | 7364264 | 7303251 |
| 7201470 | 7121655 | 7293861 | 7232208 | 7328985 | 7344232 |
| 7083272 | 11/014764 | 11/014763 | 7331663 | 7360861 | 7328973 |
| 11/014760 | 11/014757 | 7303252 | 7249822 | 11/014762 | 7311382 |
| 7360860 | 7364257 | 11/014736 | 7350896 | 11/014758 | 11/014725 |
| 7331660 | 11/014738 | 11/014737 | 7322684 | 7322685 | 7311381 |
| 7270405 | 7303268 | 11/014735 | 11/014734 | 11/014719 | 11/014750 |
| 11/014749 | 7249833 | 11/014769 | 11/014729 | 7331661 | 11/014733 |
| 7300140 | 7357492 | 7357493 | 11/014766 | 11/014740 | 7284816 |
| 7284845 | 7255430 | 11/014744 | 7328984 | 7350913 | 7322671 |
| 11/014718 | 11/014717 | 11/014716 | 11/014732 | 7347534 | 11/097268 |
| 11/097185 | 7367650 | | | | |

Typically a MEMS inkjet printhead ("MEMJET printhead") is comprised of a plurality of printhead integrated circuits, with each integrated circuit having several thousand nozzles. Each nozzle comprises an actuator for ejecting ink, which may be, for example, a thermal bend actuator (e.g. U.S. Pat. No. 6,322,195) or a bubble-forming heater element actuator (e.g. U.S. Pat. No. 6,672,709). The integrated circuits are manufactured using MEMS techniques, meaning that a high nozzle density and, hence, high resolution printheads can be mass-produced at relatively low cost.

In the manufacture of MEMS printhead integrated circuits, it is often required to perform deep or ultradeep etches to depths of over 10 micron. A problem with deep etches, especially ultradeep etches, is maintaining anisotropy during the etch—that is, ensuring the trench is etched in a vertical direction, but not in a horizontal direction. Ideally, the sidewalls of the trench should be substantially perpendicular with respect to the surface of the substrate.

It is particularly important to have perpendicular sidewalls in ultradeep trenches when etching ink supply channels through silicon wafers. MEMS printhead integrated circuits require delivery of ink to each nozzle through either an individual or a common ink supply channel. These ink channels are typically etched through wafers having a thickness of about 200 micron, and therefore place considerable demands on the ultradeep etching method employed. It is especially important that each ink channel is substantially perpendicular to the wafer surface and does not contain kinks or sidewall projections (e.g. grassing), which can interfere with the flow of ink.

In the Applicant's U.S. patent application Ser. No. 10/728,784 and Ser. No. 10/728,970 , both of which are incorporated herein by reference, there is described a method of fabricating inkjet printheads from a wafer having a drop ejection side and an ink supply side. Referring to FIG. 1, there is shown a typical MEMS nozzle arrangement 1 comprising a bubble-forming heater element actuator assembly 2. The actuator assembly 2 is formed in a nozzle chamber 3 on the passivation layer 4 of a silicon wafer 5. The wafer typically has a thickness "B" of about 200 micron, whilst the nozzle chamber typically occupies a thickness "A" of about 20 micron.

Referring to FIG. 2, an ink supply channel 6 is etched through the wafer 5 to the CMOS metallization layers of an interconnect 7. An inlet 8 provides fluid connection between the ink supply channel 6 and the nozzle chamber (removed for clarity in FIG. 2). CMOS drive circuitry 9 is provided between the wafer 5 and the interconnect 7. The actuator assembly 2, associated drive circuitry 9 and ink supply channel 6 may be formed on and through a wafer 3 by lithographically masked etching techniques, as described in U.S. application Ser. No. 10/302,274, which is incorporated herein by reference.

Referring to FIG. 3, the ink supply channel 6 is formed in the wafer 5 by first etching a trench partially through the wafer 5 from the drop ejection side (i.e. nozzle side) of the wafer. (This trench will become the inlet 8, shown in FIG. 2). Once formed, the trench is plugged with photoresist 10, as shown in FIG. 3, and the ink supply channel 6, is formed by ultradeep etching from the ink supply side of the wafer 5 to the photoresist plug 10. Finally, the photoresist 10 is stripped from the trench to form the inlet 8, which provides fluid connection between the ink supply channel 6 and the nozzle chamber 3.

Alternatively, each ink supply channel may be configured to supply ink to a plurality of nozzles which all eject the same colored ink. This arrangement is illustrated in FIG. 4 and is described in detail in the Applicant's copending application Ser. No. 10/760,254 (Applicant Ref: RRC022), the contents of which is incorporated herein by reference.

In either of these ink supply channel configurations, the "back-etching" technique avoids filling and removing an entire ink supply channel with resist whilst nozzle structures in the wafer are being lithographically formed. Notwithstanding the problems of etching anisotropically to a depth of up to 200 micron, it is also desirable when etching ink supply channels to provide hydrophilic channel sidewalls. Optimum printing conditions in an inkjet printhead are generally achieved by having a hydrophobic nozzle face and hydrophilic ink supply channels. Hydrophilic ink supply channels ensure that the aqueous-based inkjet ink is drawn into the ink supply channels from a bulk ink reservoir. A hydrophobic nozzle face ensures the formation of discrete ink droplets when the ink is ejected from each nozzle and also minimizes surface flooding during printing.

Several methods for etching ultradeep trenches into silicon are known in the art. All these methods involve deep reactive ion etching (DRIE) using a gas plasma. The semiconductor substrate, with a suitable mask disposed thereon, is placed on a lower electrode in a plasma reactor, and exposed to an ionized gas plasma formed from a mixture of gases. The ionized plasma gases (usually positively charged) are accelerated towards the substrate by a biasing voltage applied to the electrode. The plasma gases etch the substrate either by physical bombardment, chemical reaction or a combination of both. Etching of silicon is usually ultimately achieved by formation of volatile silicon halides, such as $SiF_4$, which are carried away from the etch front by a light inert carrier gas, such as helium.

Anisotropic etching is generally achieved by depositing a passivation layer onto the base and sidewalls of the trench as it is being formed, and selectively etching the base of the trench using the gas plasma.

One method for achieving ultradeep anisotropic etching is the "Bosch process" , described in U.S. Pat. Nos. 5,501,893 and 6,284,148. This is the current method of choice in commercial MEMS foundries and involves alternating polymer deposition and etching steps. After formation of a shallow trench, a first polymer deposition step deposits a polymer onto the base and sidewalls of the trench. The polymer is deposited by a gas plasma formed from a fluorinated gas (e.g. $CHF_3$, $C_4F_8$ or $C_2F_4$) in the presence or in the absence of an inert gas. In the subsequent etching step, the plasma gas mix is changed to $SF_6$/Ar. The polymer deposited on the base of the trench is quickly broken up by ion assistance in the etching step, while the sidewalls remain protected. Hence, anisotropic etching may be achieved. However, a major disadvantage of the Bosch process is that polymer deposition and etching steps need to be alternated, which means continuously alternating the gas composition of the plasma. This alternation, in turn, leads to slow etch rates and uneven trench sidewalls, characterized by scalloped surface formations. Plasma instability as the gas chemistry is switched also tends to exacerbate the formation of uneven sidewalls.

Moreover, the Bosch etch leaves a hydrophobic polymer coating on trench sidewalls. As discussed above, hydrophobic sidewalls are undesirable in fluidics applications, such as ink supply channels for inkjet printheads. Accordingly, in inkjet printhead applications, the Bosch etch is usually followed by a post-etch cleaning process, such as EKC wet cleaning, dry $O_2$ plasma ashing or combinations thereof The post-etch cleaning process is intended to remove the hydrophobic polymer and leave channel sidewalls coated with $SiO_2$. However, post-etch cleaning processes undesirably add to the number of fabrication steps and can also lead to their own inherent problems, such as wafer-cracking during EKC cleaning.

A modification of the cyclical Bosch process is described in U.S. Pat. No. 6,127,278, assigned to Applied Materials, Inc. In the Applied Materials process, a first passivation etch is performed using a $HBr/O_2$ plasma, followed by a main etch using a $SF_6/HBr/O_2$ in alternating succession. The HBr enhances passivation, probably by formation of relatively nonvolatile silicon bromides in the passivation layer. However, the problem of hydrophobically coated sidewalls still remains with the Applied Materials process.

In order to avoid the cumbersome Bosch process, in which plasma gases need to be continuously alternated, anisotropic etching techniques were developed, which use simultaneous sidewall passivation. In such etching methods, a plasma mix is formed from a passivating component and an etching component. A typical plasma mix is formed from $O_2/SF_6$ with the addition of He as a carrier gas being highly recommended to enhance ion dispersement. The plasma mix simultaneously passivates and etches, which avoids the disadvantages of-the Bosch process. Nevertheless, it is the general view that mixing the gases gives less effective anisotropic etching, because the two processes tend to be self-cancelling. Accordingly, simultaneous sidewall passivation etching has been mostly confined to etching relatively shallow trenches. For ultradeep anisotropic etching, alternating passivation/etching is by far the most preferred technique.

One successful process for etching ultradeep trenches, which does not require alternating plasma gas mixtures, is the "Lam process" described in U.S. Pat. No. 6,191,043. In the Lam process, a passivating/etching plasma is formed from a mixture of $O_2$, $SF_6$, He and Ar—the $O_2$ is a passivating gas; the $SF_6$ is an etching gas; the He is a carrier gas; and the Ar is a bombardment-enhancing gas. Trench depths of up to 60 micron have been reported using the Lam process with acceptable etch rates. However, the process has not been used widely and etch depths of greater than 60 micron have not been reported.

None of the above-described etch processes can be used to etch trenches through a typical wafer to a depth of over 100 micron, whilst leaving hydrophilic sidewalls. Even when the etch process (or post-etch treatment) leaves $SiO_2$-coated sidewalls, these $SiO_2$-coated sidewalls are not particularly hydrophilic, having a contact angle of about 60°. Truly hydrophilic surfaces have contact angles of less than 50°, preferably less than 40° or preferably less than 30°.

It would be desirable to provide a new reactive ion etching process, which is capable of anisotropically etching ultradeep trenches of over 100 micron. It would be particularly desirable for the process to leave hydrophilic sidewalls after the etch, without the need for any post-etch hydrophilization treatments.

SUMMARY OF THE INVENTION

In a first aspect, the present invention provides a method of deep reactive ion etching a trench into a substrate, said method comprising an etching process using an etching gas plasma and passivation process using a passivating gas plasma, wherein said passivating gas plasma comprises a hydrophilizing dopant.

In a second aspect, there is provided a method of fabricating an inkjet printhead comprising the steps of:

(i) providing a wafer having a drop ejection side and an ink supply side;

(ii) etching a plurality of trenches partially through said drop ejection side of said wafer;

(iii) filling said trenches with photoresist;

(iv) forming a plurality corresponding nozzles, ejection actuators and associated drive circuitry on said drop ejection side of said wafer using lithographically masked etching techniques;

(v) etching a plurality of corresponding ink supply channels from said ink supply side of said wafer to said photoresist; and (vi) stripping said photoresist from said trenches to form nozzle inlets, thereby providing fluid connection between said ink supply side and said nozzles, wherein said ink supply channels are etched using the etching method described above.

In a third aspect, there is provided a substrate comprising at least one feature etched in a surface of the substrate, said feature having the characteristics of:

(a) a depth of over 100 micron;

(b) sidewalls substantially perpendicular to said surface; and (c) sidewalls having a contact angle of less than 50°.

In a fourth aspect, there is provided an inkjet printhead comprising:

a substrate having a drop ejection side and an ink supply side;

a plurality of nozzle assemblies formed on said drop ejection side of said wafer, each nozzle assembly having an ink inlet; and a plurality of ink supply channels defined in said ink supply side, each ink supply channel being in fluid communication with at least one ink inlet, wherein said ink supply channels have the characteristics of:

(a) a depth of over 100 micron;

(b) sidewalls substantially perpendicular to a surface defined by the ink supply side of the substrate; and (c) sidewalls having a contact angle of less than 50°.

The etching method of the present invention provides a means by which trenches or channels can be formed in substrates. The trenches or channels advantageously have hydrophilic sidewalls by virtue of the hydrophilizing dopant present in the etching plasma gas chemistry. Hence, the method is highly suitable for forming trenches or channels used in aqueous fluidic applications, such as ink supply channels in inkjet printheads.

The etching method may be used for etching ultradeep trenches into silicon, having a depth of at least 100 micron, with acceptable etch rates. Moreover, minimal RIE lag is observed using this method. The method also provides highly anisotropic etching, whereby the trenches formed have substantially perpendicular sidewalls with respect to the substrate surface. By "substantially perpendicular" , it is meant that the taper angle of the sidewalls is between 85° and 95°, preferably between 87° and 93°, and more preferably between 88° and 92°.

Additional practical advantages of the present invention include the potential avoidance of any post-etch cleanup steps such as EKC wet cleaning or $O_2$ plasma dry ashing.

DETAILED DESCRIPTION OF OPTIONAL FEATURES

The etching plasma is typically generated in a plasma etching reactor, such as an inductively coupled plasma etching reactor. Plasma etching reactors are well known in the art and are commercially available from various sources (e.g. Surface Technology Systems, PLC). Typically, the etching reactor comprises a chamber formed from aluminium, glass or quartz, which contains a pair of parallel electrode plates. However, other designs of reactor are available and the present invention is suitable for use with any type of plasma etching reactor.

A radiofrequency (RF) energy source is used to ionize plasma gases introduced into the chamber. The ionized gases are accelerated towards a substrate disposed on a lower electrode (electrostatic chuck) by a biasing voltage. Hence, etching is achieved by a combination of physical bombardment and chemical reaction. Various control means are provided for controlling the relative ratios of plasma gases, the biasing voltage, the RF ionizing energy, the substrate temperature, the chamber pressure etc. It will, of course, be within the ambit of the skilled person's common general knowledge to vary plasma reactor parameters in order to optimize etching conditions. For example, the chamber pressure is usually in the range of 5 to 100 mTorr, which is typical for deep reactive ion etching (DRIE).

Optionally, the total amount of hydrophilizing dopant is such that it comprises less than 10 vol %, less than 8 vol %, or less than 5 vol % of the passivating gas plasma. The dopant may be introduced into the plasma chamber as either a liquid or a gas. The toxic or explosive nature of some hydrophilizing dopants (e.g. $B_2H_6$) means that liquids are sometimes preferred to gases. Liquids will, of course, be rapidly vaporized in the plasma chamber.

Optionally, the hydrophilizing dopant comprises a boron-containing compound, a phosphorus-containing compound or combinations thereof. Optionally, the hydrophilizing dopant comprises a compound selected from $B_2H_6$, $PH_3$, trimethyl borate (TMB), trimethyl phopshite (TMP) or combinations thereof.

Boron and phosphorus dopants are well known in the formation of silicon glasses. Accordingly, trench sidewalls resulting from the etch typically comprise phosphosilicate glass (PSG), borosilicate glass (BSG), borophosphosilicate glass (BPSG) or combinations thereof. Such glasses are known to be more hydrophilic than silicon dioxide.

Optionally, the trench sidewalls resulting from the etch have a contact angle of less than 50°, less than 40°, or less than 30°. These are hydrophilic contact angles and contrast with the highly hydrophobic sidewalls resulting from the Bosch etch. They are also significantly more hydrophilic than $SiO_2$ sidewalls, which typically have a contact angle of about 60°.

As mentioned above, the method of the present invention generally provides substantially anisotropic etching, providing trenches with substantially perpendicular sidewalls, to depths of over 100 micron, over 200 micron or over 300 micron, with aspect ratios of over 1.5:1, over 2:1, over 5:1, over 10:1 or over 20:1. This is particularly advantageous for etching ink supply channels during printhead fabrication.

Optionally, the method is used to etch a plurality of trenches in a substrate simultaneously, wherein the positions of the trenches are defined by a mask layer on the substrate. Typically, the mask is an oxide layer (e.g. Thermally Enhanced Oxide Silicon ("TEOS") or a photoresist.

Surprisingly high substrate: mask selectivities are observed using the method of the present invention. Selectivity is important, because it is imperative that the mask does not wear away when etching ultradeep trenches. In general, higher substrate: mask selectivities are achievable using hard oxide masks as compared to soft photoresist masks. With a soft photoresist mask, the present invention typically gives a substrate: mask selectivity of least 30:1, optionally at least 40:1 or-optionally at least 50:1. With a hard oxide mask, the present invention typically gives a substrate: mask selectivity of least 80:1, optionally at least 90:1 or optionally at least 100:1. Such high selectivities are surprising, given that the method relies, to a large extent, on physical bombardment of the substrate.

The method of the present invention generally provides acceptably high etch rates. In a typical silicon etch, etch rates of at least 4 micron/min, optionally at least 5 micron/min, optionally at least 6 micron/min, or optionally at least 7 micronlmin are usually achievable. Accordingly, the method is suitable for etching ultradeep trenches (e.g. 200 micron long trenches), which can be used as ink supply channels in printheads.

In one embodiment, the invention employs simultaneous sidewall passivation during etching. With simultaneous etching/sidewall passivation, the method comprises the step of etching a trench into the substrate using an etching and passivating gas plasma. The etching and passivating gas plasma optionally comprises: (a) a passivating gas comprising oxygen; (b) an inert sputtering gas; (c) a fluorinated etching gas; and (d) a hydrophilizing dopant (as described above).

Optionally, the inert sputtering gas is argon. Optionally, the flow rate of the inert sputtering gas is in the range of 100 to 300 sccm, or 150 to 250 sccm. Optionally, the gas chemistry may comprise other inert gases, such as helium. However, it is generally preferred to use Ar alone in order to simplify control of the gas chemistry.

The fluorinated etching gas may be any fluorine-based gas, which can produce fluorine radicals and etch silicon in a plasma etching reactor. The fluorinated gas may be, for example $SF_6$, $NF_3$ or mixtures thereof. Optionally, the fluorinated gas is $SF_6$. Optionally, the flow rate of the fluorinated gas is in the range of 10 to 100 sccm, or 20 to 80 sccm. Optionally, the ratio of inert sputtering gas (e.g. argon) to fluorinated gas is in the range of 2-20 to 1, or 2-10 to 1.

The passivating gas may comprises other passivating components in addition to oxygen. For example, HBr may also be present in order to assist with passivation. Optionally, the flow rate of passivating gas is in the range of 10 to 80 sccm, or 15 to 60 sccm. Optionally, the ratio of inert sputtering gas to passivating gas is in the range of 2-20 to 1, more preferably, 3-15 to 1. Optionally, the ratio of fluorinated etching gas to passivating gas is in the range of 3:1 to 1:3, or 2:1 to 1:2, or 3:2 to 2:3.

Without wishing to be bound by theory, the source of anisotropy during simultaneous etching/passivation may be understood by the following processes:

Oxygen and fluorine radicals are first generated in the plasma according to equations [1] and [2]:

$$SF_6+e^-\rightarrow S_xF_y^++S_xF_y^++F^++e^- \quad [1]$$

$$O_2+e^-\rightarrow O^++O^-+e^- \quad [2]$$

The oxygen radicals passivate the silicon surface by first adsorbing onto the surface and then reacting to form an oxide film:

$$O^+Si(s)\rightarrow Si(s)\text{-}nO\rightarrow SiO_n(sf) \quad [3]$$

The oxide passivation layer covers both the sidewalls and the base of the trench. However, at the base of the trench, the oxide layer can be removed by the following processes:

$$SiO_n(sf)+F^+\rightarrow SiO_n(sf)\text{-}F[ \quad 4]$$

$$SiO_n(sf)\text{-}nF\rightarrow \text{ion energy}\rightarrow SiF_x(ads)+SiO_xF_y(ads)[5]$$

The adsorbed silicon fluoride and silicon oxyfluoride species dissociate from the silicon surface, either by their natural volatility or by physical sputtering. With the silicon at the base of the trench revealed, the fluorine radicals in the plasma can proceed with etching. The etching is driven by the volatility of silicon fluoride species:

$$Si(s)+F^+\rightarrow Si\text{-}nF \quad [6]$$

$$Si\text{-}nF\rightarrow \text{ion energy}\rightarrow SiF_x(ads) \quad [7]$$

$$SiF_x(ads)\rightarrow SiF_x(g) \quad [8]$$

In preceding equations [1] to [8], (s) represent surface; (sf) represents surface film; (ads) represents adsorbed; (g) represents gas; and x, y and n are arbitrary integers representing indefinable potentially mixed oxidation state species.

In terms of achieving anisotropy during the etch, equation [5] represents the key step. The passivation layer at the base of the trench is removed by a process assisted by ion energy. Since the etching plasma is accelerated perpendicularly towards the silicon substrate in the plasma reactor, the sidewalls of the trench do not receive the same ion energy as the base. Hence, anisotropic etching can be achieved.

In general, the greater the ion energy in the plasma, the greater the degree of anisotropy that can be achieved. One way of achieving high ion energy is to increase the bias power in the plasma reactor. However, an alternative way of achieving high ion energy is to use heavy ions, such as argon ions, in the plasma.

In an alternative embodiment, the invention employs alternating etching and sidewall passivation steps in a quasi Bosch process. With alternating etching/passivation, the method comprises the steps of:

(i) etching into the substrate using an etching gas plasma, the etching gas plasma comprising:

(a) a fluorinated etching gas; and (b) an inert sputtering gas;

(ii) passivating exposed surfaces of the substrate using a passivating gas plasma, the passivating gas plasma comprising:

(a) a silicon-containing deposition gas; and (b) a hydrophilizing dopant; and (iii) alternatingly repeating steps (i) and (ii).

The fluorinated etching gas, the inert sputtering gas and the hydrophilizing dopant are generally as described previously.

Typically, the silicon-containing deposition gas comprises $SiH_4$, although any silicon-containing deposition gas (e.g. vaporized TEOS) may be used Other gases that may be optionally present in the passivating gas plasma include $N_2$, $N_2O$, $NH_3$, $O_2$ or combinations thereof. Hence, the passivating step (ii) resembles a typical process for depositing phosphosilicate glass (PSG), borosilicate glass (BSG) or borophosphosilicate glass (BPSG) onto a substrate. The etching step (i) resembles a typical etching step in a Bosch process.

GENERAL EXPERIMENTAL PROCEDURE

Figure 1:
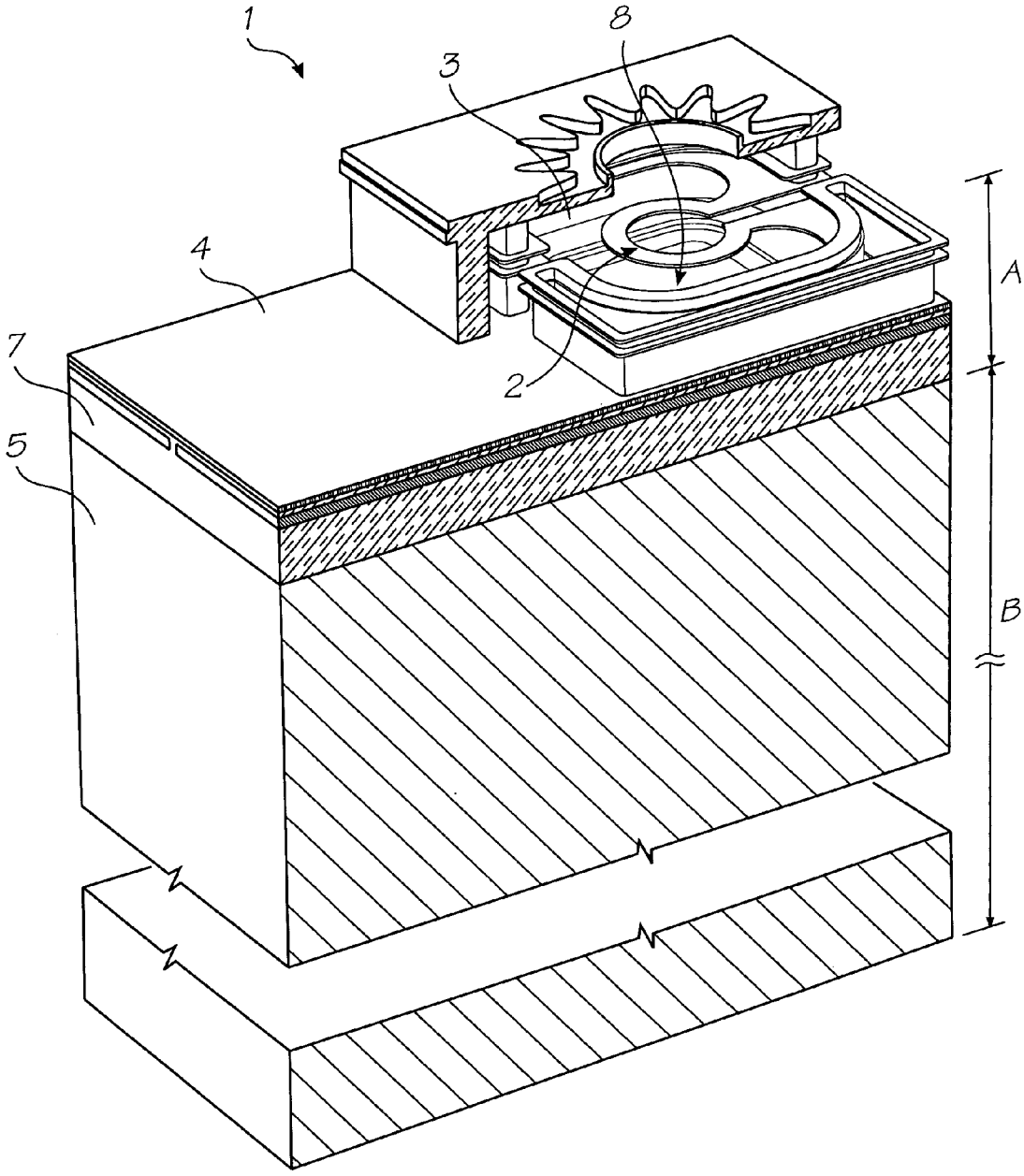
FIG. 1 is a perspective view of a nozzle arrangement for a printhead.
Figure 2:
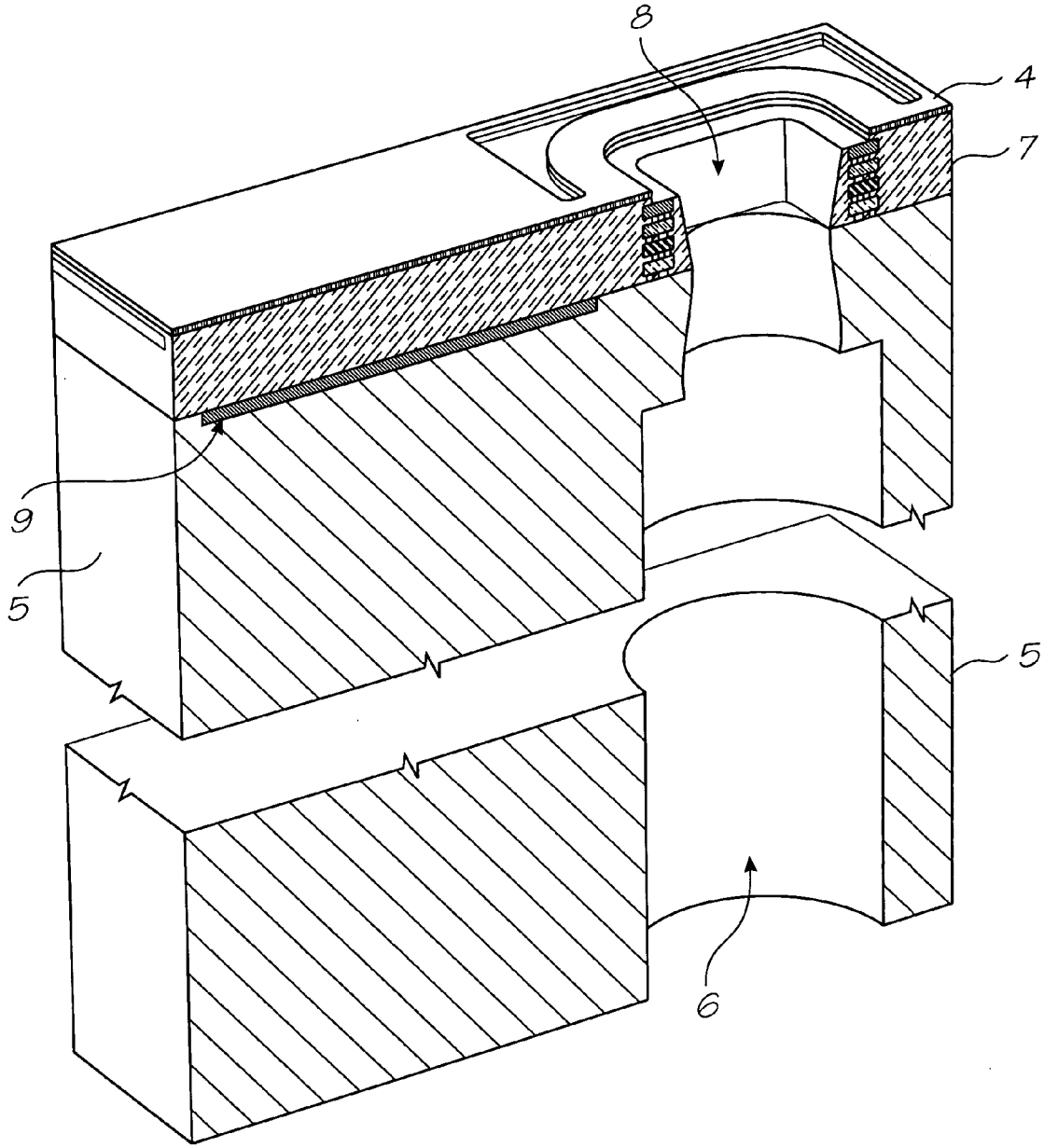
FIG. 2 is a cutaway perspective view of the nozzle arrangement shown in FIG. 1 with the actuator assembly removed.
Figure 3:
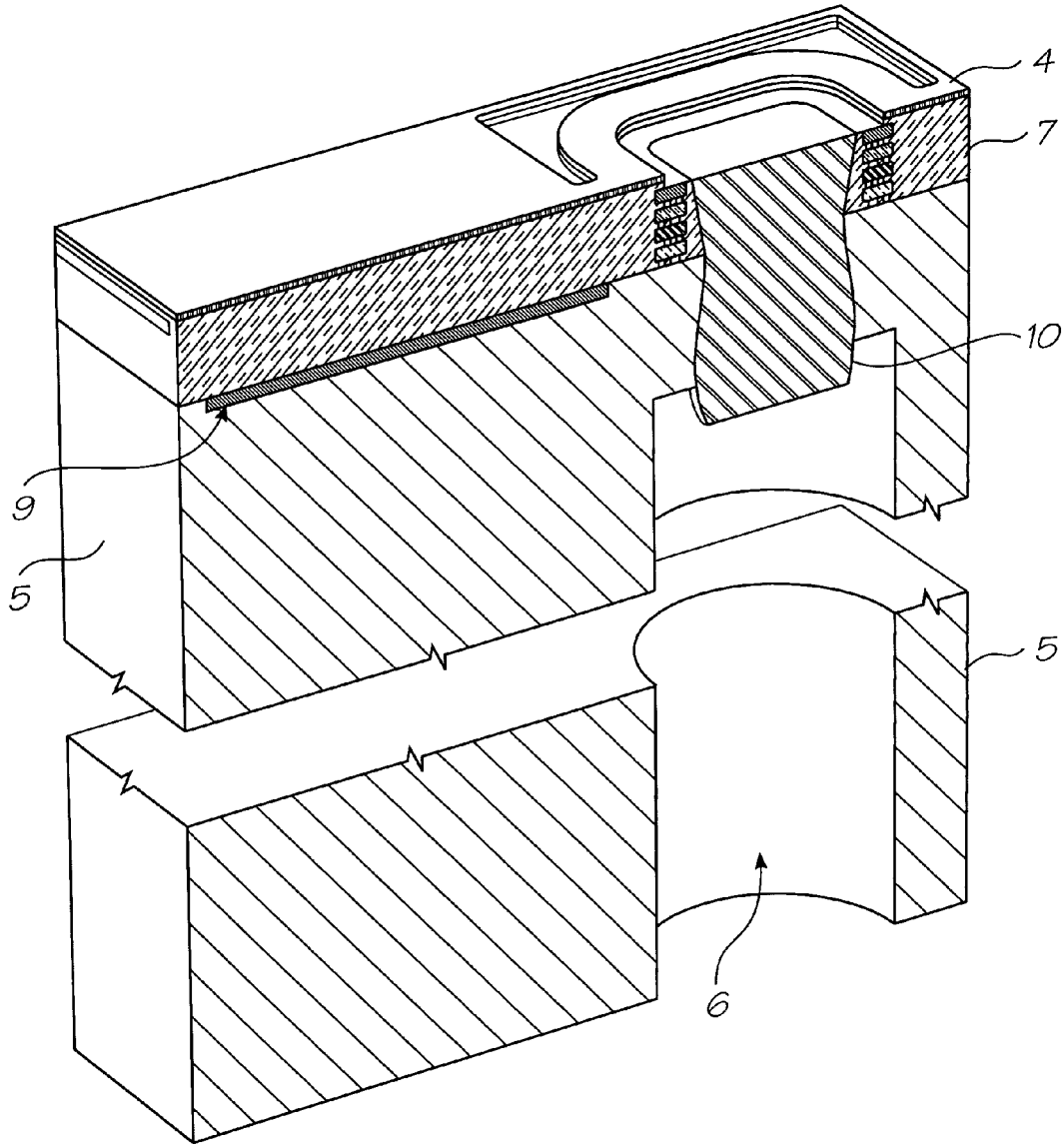
FIG. 3 is a cutaway perspective view of the printhead nozzle arrangement shown in FIG. 2 before stripping away the photoresist plug.
Figure 4:
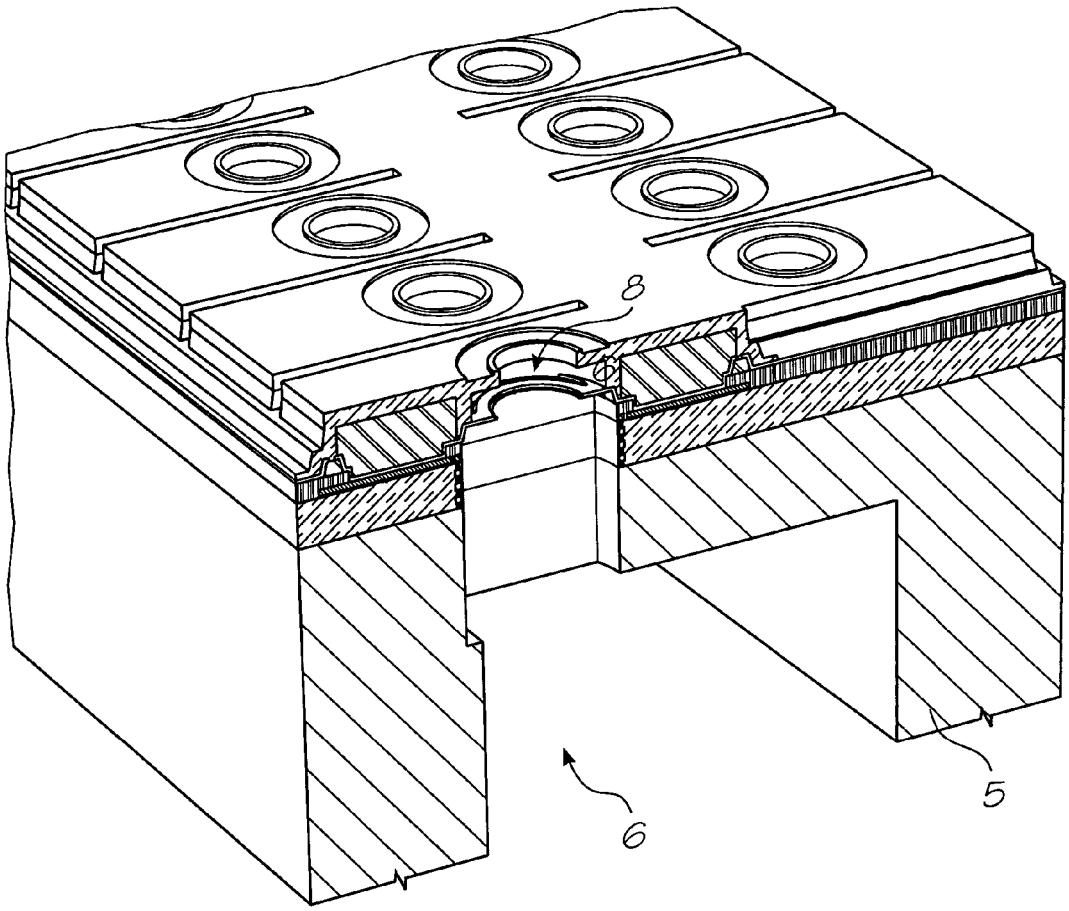
FIG. 4 is a cutaway perspective view of an alternative ink supply channel arrangement.

All etches are performed in a standard inductively coupled plasma DRIE reactor. The reactor is configured as follows:

| | |
|---|---|
| ICP: | 1.9-2.2 MHz, 2000 W Max |
| Bias: | 13.56 MHz, 1250 W Max |
| Lower Electrode: | Anodized Electrostatic Chuck (ESC), 1000 W Max |
| Chamber: | Anodized, 1.4 litre chamber volume |
| Pump: | 2 litre turbo |
| Cooling: | Backside helium cooling |

It will, of course, be appreciated that the present invention has been described purely by way of example and that modifications of detail may be made within the scope of the invention, which is defined by the accompanying claims.

The invention claimed is:

1. A method of fabricating an inkjet printhead comprising the steps of:

(i) providing a wafer substrate having a drop ejection side and an ink supply side;

(ii) etching a plurality of trenches partially through said drop ejection side of said wafer;

(iii) filling said trenches with photoresist;

(iv) forming a plurality corresponding nozzles, ejection actuators and associated drive circuitry on said drop ejection side of said wafer using lithographically masked etching techniques;

(v) etching a plurality of corresponding ink supply channels from said ink supply side of said wafer to said photoresist, said etching comprising an etching process using an etching gas plasma and a passivation process using a passivating gas plasma, wherein said passivating gas plasma comprises a hydrophilizing dopant; and (vi) stripping said photoresist from said trenches to form nozzle inlets, thereby providing fluid connection between said ink supply side and said nozzles.

2. The method of claim 1, wherein said substrate is silicon.

3. The method of claim 1, wherein said etching gas plasma is generated in a plasma etching reactor, and said substrate is etched in said reactor.

4. The method of claim 1, wherein ink supply channel sidewalls resulting from the etch have a contact angle of less than 50°.

5. The method of claim 1, wherein the hydrophilizing dopant comprises a boron-containing compound, a phosphorus-containing compound or combinations thereof.

6. The method of claim 1, wherein the hydrophilizing dopant comprises a compound selected from the group consisting of $B_2H_6$, $PH_3$, trimethyl borate (TMB), trimethyl phopshite (TMP) or combinations thereof.

7. The method of claim 1, wherein ink supply channel sidewalls resulting from the etch comprise phosphosilicate glass (PSG), borosilicate glass (BSG), borophosphosilicate glass (BPSG) or combinations thereof.

8. The method of claim 1, wherein the ink supply channels have a depth of over 100 micron.

9. The method of claim 1, wherein a plurality of ink supply channels are etched into said substrate simultaneously, the positions of said ink supply channels being defined by a mask layer disposed on said substrate.

10. method of claim 9, wherein said mask layer is an oxide layer or a photoresist layer.

11. The method of claim 10, wherein the substrate: mask selectivity is at least 30:1.

12. The method of claim 9, wherein the etch rate is at least 4 micron/mm.

13. The method of claim 1 comprising simultaneous etching and passivation processes, wherein a single etching and passivating gas plasma comprises said etching gas plasma and said passivating gas plasma.

14. The method of claim 13, wherein said etching and passivating gas plasma comprises:

(a) a passivating gas comprising oxygen;

(b) an inert sputtering gas;

(c) a fluorinated etching gas; and (d) a hydrophilizing dopant.

15. The method of claim 14, wherein said inert sputtering gas is argon.

16. The method of claim 14, wherein said fluorinated etching gas is selected from the group consisting of $SF_6$, $NF_3$ and mixtures thereof.

17. The method of claim 1 comprising alternating etching and passivation processes.

18. The method of claim 17, comprising the steps of:

(i) etching into said substrate using an etching gas plasma, said etching gas plasma comprising:

(a) a fluorinated etching gas; and (b) an inert sputtering gas;

(ii) passivating exposed surfaces of the substrate using a passivating gas plasma, said passivating gas plasma comprising:

(a) a silicon-containing deposition gas; and (b) a hydrophilizing dopant;

(iii) alternatingly repeating steps (i) and (ii).

19. The method of claim 18, wherein said inert sputtering gas is argon.

20. The method of claim 18, wherein said fluorinated etching gas is selected from the group consisting of $SF_6$, $NF_3$ and mixtures thereof.

21. The method of claim 18, wherein said silicon-containing deposition gas comprises $SiH_4$.

22. The method of claim 18, wherein said passivating gas plasma further comprises a gas selected from $O_2$, $N_2$, $N_2O$, $NH_3$ or combinations thereof.

23. The method of claim 18, wherein the passivation step deposits, on the exposed surfaces, a phosphosilicate glass (PSG), a borosilicate glass (BSG), a borophosphosilicate glass (BPSG) or combinations thereof.

* * * * *